US007198327B2

(12) United States Patent
Bergin

(10) Patent No.: US 7,198,327 B2
(45) Date of Patent: Apr. 3, 2007

(54) WRITING PLATFORM SUPPORTABLE BY A CUPHOLDER AND METHOD OF USE

(75) Inventor: Peter W. A. Bergin, Rancho Mirage, CA (US)

(73) Assignee: Caddy Products, Inc., Thousand Palms, CA (US)

( * ) Notice: Subject to any disclaimer, the term of this patent is extended or adjusted under 35 U.S.C. 154(b) by 0 days.

(21) Appl. No.: 11/092,244

(22) Filed: Mar. 29, 2005

(65) Prior Publication Data

US 2006/0249999 A1 Nov. 9, 2006

(51) Int. Cl.
*A47C 7/62* (2006.01)

(52) U.S. Cl. ..... 297/188.18; 297/160; 297/153; 297/135; 297/188.2

(58) Field of Classification Search ..... 248/311.2; 297/160, 153, 135, 145, 188.18, 188.2, 170; 108/26

See application file for complete search history.

(56) References Cited

U.S. PATENT DOCUMENTS 2,776,177 A * 1/1957 Vance ..... 297/170
3,498,470 A * 3/1970 Thomas ..... 211/74
4,798,413 A * 1/1989 Capelli ..... 297/161
5,118,063 A * 6/1992 Young, Sr. ..... 248/311.2
5,651,523 A * 7/1997 Bridges ..... 248/311.2
5,865,124 A * 2/1999 Wroe ..... 108/26
6,109,580 A * 8/2000 Stern et al. ..... 248/311.2
6,412,862 B1 * 7/2002 Dickerson et al. ..... 297/188.14
6,520,366 B1 * 2/2003 Bradley et al. ..... 220/23.2
6,533,233 B2 * 3/2003 Thomas ..... 248/311.2
6,732,990 B2 * 5/2004 Hudson ..... 248/311.2

* cited by examiner

*Primary Examiner*—Laurie K. Cranmer
(74) *Attorney, Agent, or Firm*—Westman, Champlin & Kelly, P.A.

(57) ABSTRACT

A desk tray for positioning within a cupholder of an arm rest where the tray includes a substantially flat upper surface having a receptacle extending downwardly therefrom. The receptacle is positioned within the cupholder such that the arm rest provides support to the substantially flat upper surface where the flat upper surface supports a book, a laptop computer or a notepad for a person attending a class or a seminar.

12 Claims, 3 Drawing Sheets

WRITING PLATFORM SUPPORTABLE BY A CUPHOLDER AND METHOD OF USE

BACKGROUND OF THE INVENTION

The present invention relates to a portable support platform for supporting writing materials and/or a laptop computer. More particularly, the present invention relates to a platform for supporting writing materials and/or laptop computers where the platform is used in combination with a standard cupholder receptacle supporting arm rest structures found in various educational and entertainment facilities.

Most modern theaters and large auditoriums provide an arm rest that is secured to an upper surface of seating structure positioned between adjacent seats. The arm rest, in addition to functioning as a standard arm rest, supports a cupholder for a user's convenience. While the cupholders vary somewhat in design, all the cupholders are typically configured to receive a slightly tapered beverage cup within a circular cross-sectional cupholder.

Many educational classes and seminars are now held in auditoriums and theaters having the before mentioned arm rests and cupholders attached thereto. The cupholders have, for the most part, provided satisfactory service in allowing the student or seminar attendee to securely place a single cup therein. However, the cupholder arm rest combinations are limited in providing additional support surfaces for items such as a laptop computer, or a writing tablet or book used while attending the class or seminar.

Because there is no place to support a book, notepad or a laptop computer, the student or seminar attendee is usually left to support the educational material or note taking device on the user's lap. Supporting the computer, book or notepad on the user's lap positions the student or attendee in an uncomfortable position which may detract from the learning or educational experience.

SUMMARY OF THE INVENTION

The present invention includes a desk tray that is secured within a cupholder of an arm rest. The tray includes a generally flat upper surface that has a receptacle extending downwardly therefrom. The receptacle is positioned within the cupholder such that the cupholder and arm rest support the generally flat surface. The generally flat surface provides support to a computer, a book or a notepad for a student or an attendee of a seminar.

DETAILED DESCRIPTION OF THE PREFERRED EMBODIMENTS

Figure 1:
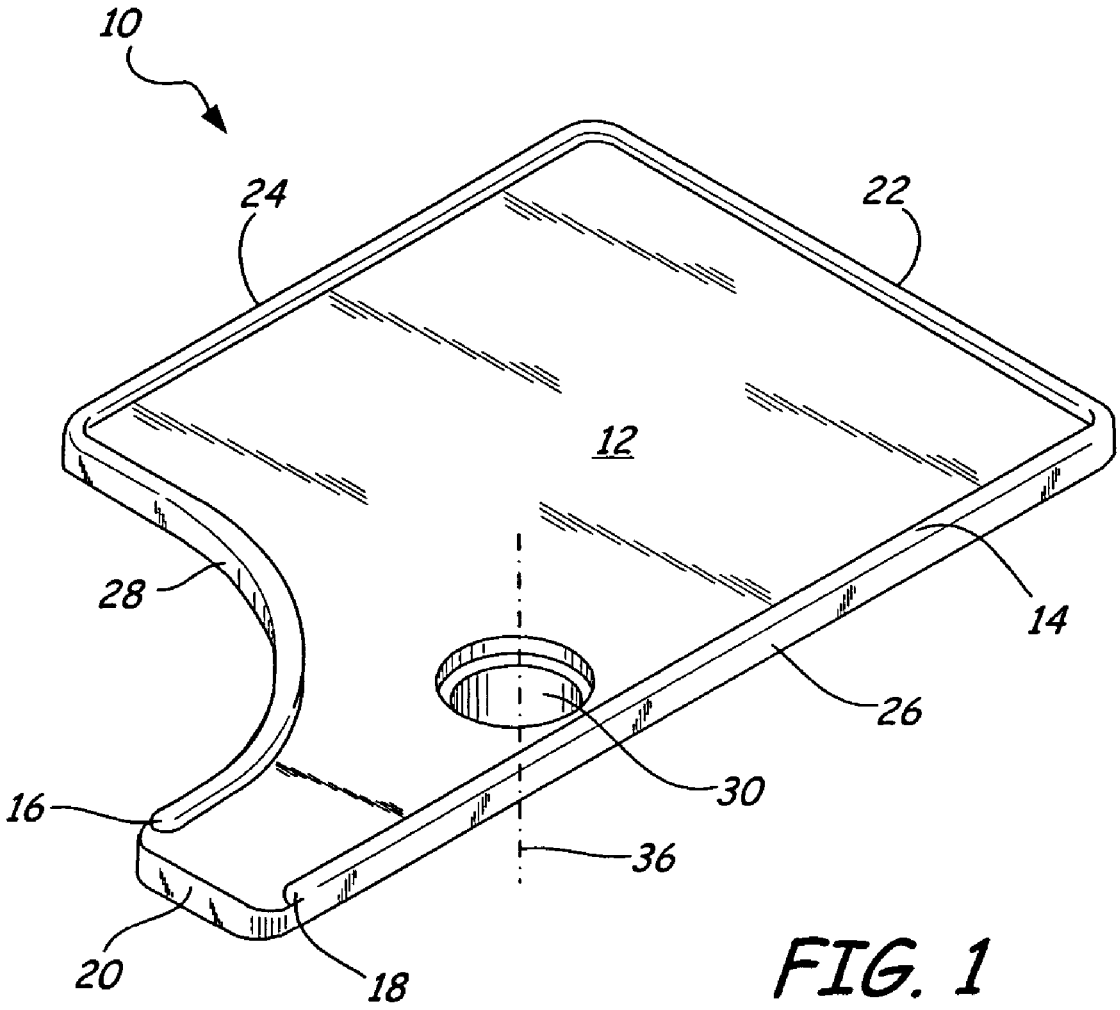
FIG. 1 is a perspective view of a desk tray of the present invention.

A desk tray for inserting into a cup receptacle of an arm rest is generally illustrated at 10 in FIG. 1. The desk tray 10 is preferably formed as an integral one piece, molded plastic unit, which is capable of nesting or stacking in a nesting manner with a plurality of similarly configured and formed desk trays 10. Alternatively, the desk tray 10 may be fabricated of other materials such as composite particle material, paper pulp material or other formable particular material such as wood, flour or starch pulp molding materials.

The desk tray 10 is fabricated having a substantially flat upper surface 12 onto which a tablet, loose leaf paper, a book or a laptop computer can be supported. The desk tray 10 includes a lip 14 that extends generally around a perimeter of the substantially flat surface 12 where the lip 14 aids in retaining the tablet, loose leaf paper, book and/or laptop computer on the substantially flat surface 12. The lip 14 has terminal ends 16, 18 at a back end 20 such that the back end 20 has a generally smooth flat surface that provides a comfortable surface upon which a forearm of a student or attendee can be placed.

Extending downward from the lip 14 are a front side wall 22, a left side wall 24, a right side wall 26, and a generally arcuate back side wall 28, which define a continuous side wall about a perimeter of the desk tray. The side walls 22, 24, 26, 28 provide structural integrity to the desk tray 10 and prevent the desk tray 10 from flexing as pressure is applied to the substantially flat surface 12.

Figure 2:
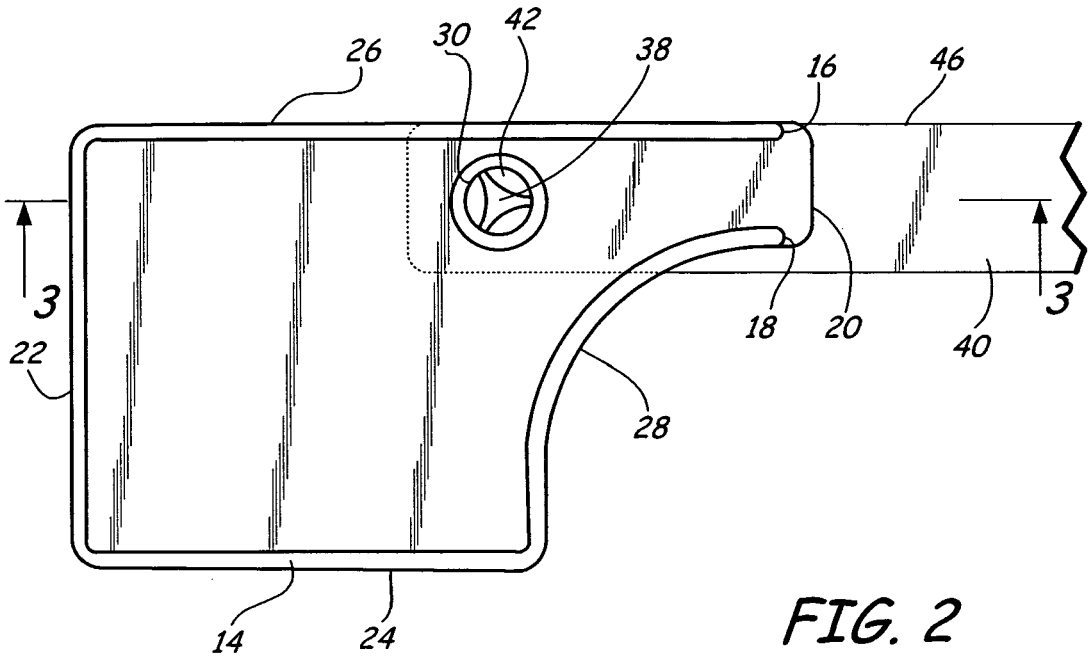
FIG. 2 is a top view of the tray of the desk tray of the present invention.
Figure 3:
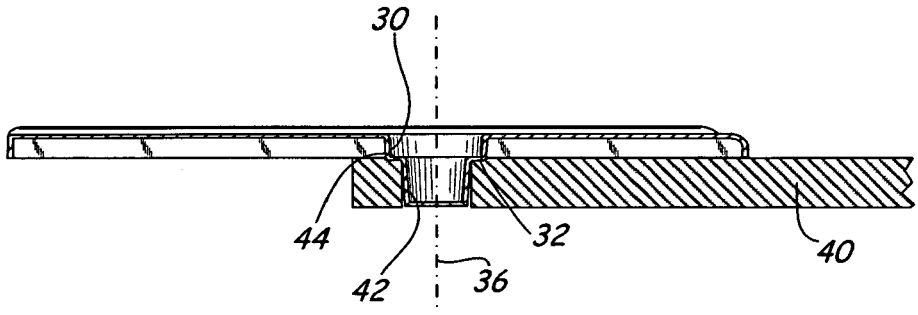
FIG. 3 is a sectional view of the desk tray of the present invention along section line 3—3 in FIG. 2.

Referring to FIGS. 1, 2 and 3, a cup receptacle 30 is positioned proximate the right side wall 26 where the cup receptacle 30 is positioned within a cupholder 42 of an arm rest 40. The receptacle 30 has a generally circular cross section and includes a shoulder 32 for engaging a top surface 44 of the arm rest 40.

Figure 4:
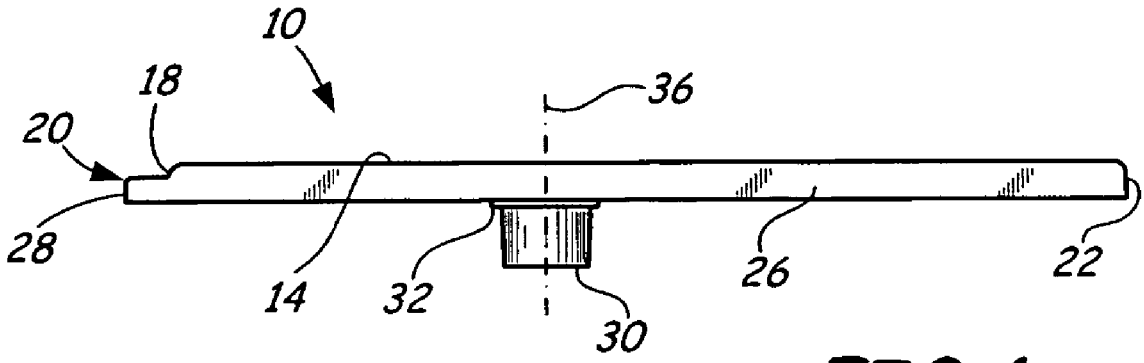
FIG. 4 is a side view of the desk tray of the present invention.

Referring to FIG. 4, the shoulder 32 is substantially even with bottom edges of the front side wall 22, the right side-wall 26, the left side wall (not shown) and the back side wall 28 such that when the receptacle 30 is positioned within the cupholder 42, the receptacle is rotatable within the cupholder 42. Depending upon the configuration of the arm rest 40, the desk tray 10 may be rotatable 360° about a central axis 36 of the receptacle 30.

Referring to FIGS. 1 and 2, while functioning as an attachment mechanism for the desk tray 10 to the arm rest 40, the receptacle 30 can also be used to position and hold a beverage container (not shown) such as a bottle or a cup. A bottom surface 38 is slotted to allow liquid to drain from the receptacle 30 even if the beverage is spilled in the receptacle 30.

The receptacle 30 is positioned proximate the right side wall 26 such that the right side wall 26 does not protrude significantly beyond an outer edge 46 of the arm rest 40. Positioning the receptacle 30 proximate the right side wall 26 allows a person in the seat to effectively use the substantially flat top surface 12 for supporting a laptop computer, book or note paper while not disrupting the person in the adjacent seat. The back side wall 28 has a generally concave arcuate configuration to provide additional space for the person in the seat to move therein without having his/her movement impeded by the desk tray 10.

The substantially flat surface 12 has a substantially rectangular configuration with an arcuate cutout corner defined by the back side wall 28. However, other configurations of the substantially flat top surface are within the scope of the present invention.

Depending upon the needs of the person in the seat and the positioning of others next to the person, the attendee or student can position the desk tray 10 of the present invention in the cupholder 42 in the arm rest 40 to the left or to the right of the student or attendee by positioning the receptacle 30 within the cupholder 42. Additionally, the student or attendee can rotate the receptacle 30 within the cupholder 42 to position the substantially flat surface 12 toward or away from the student or attendee or to configure the substantially flat surface 12 to better support the books, notepad or the laptop computer or any other learning tools required by the student or attendee.

The desk tray 10 of the present invention is also useful for schools and theater companies that are attempting to minimize their initial capital expense outlay when constructing or retrofitting a space. Provided the arm rests 40 contain cupholders 42 in the planned space or in the existing space, the school or theater company can purchase the desk tray 10 of the present invention at any time thereafter and provide students and/or attendees the facilities required for a class or seminar.

Prior to the desk tray 10 of the present invention, the classroom, auditorium or theater typically was equipped with a rigid desk type member that was nested within a slot in the arm rest. However, these desk type members that nest within the arm rest require extensive initial capital and are difficult to retrofit to another configuration or use.

When the student or seminar attendee has completed the class or seminar, the student or attendee removes the receptacle 30 from the cupholder 42 and can nest the desk trays 10 one on top of another by inserting one receptacle 30 into another and thereby efficiently stack the desk tray 10 in a convenient location for the next class or seminar. Therefore, the desk tray 10 of the present invention provides the student or attendee the necessary facilities to effectively take notes and learn while attending the class or seminar while minimizing capital outlay and allowing for flexibility for the school or facility owner.

Although the present invention has been described with reference to preferred embodiments, workers skilled in the art will recognize that changes may be made in form and detail without departing from the spirit and scope of the invention.

What is claimed is:

1. A desk tray supportable on an arm rest cupholder comprising:

a generally continuous flat upper surface extending between and having a perimeter defined by two opposing edges and a forward edge extending between the two opposing edges and being sufficiently large to effectively take notes;

a receptacle extending from the generally flat upper surface for positioning within the arm rest cupholder wherein the receptacle is rotatable within the arm rest cupholder such that the generally flat continuous surface is positionable to support a laptop computer, a book or a note pad in a selected position and the continuous flat surface being free of raised areas between the two opposing edges and the forward edge;

a generally flat back surface area contiguous with the generally flat upper surface for resting a forearm; and a lip extending along the perimeter, the lip having terminal ends spaced apart at the back surface area.

2. The desk tray of claim 1 and wherein the generally flat upper surface comprises a generally rectangular configuration with an arcuate cut out portion for providing space for a person seated in a seat having the arm rest.

3. The desk tray of claim 1 and further comprising downward extending side walls about the perimeter of the generally flat top surface.

4. The desk tray of claim 1 and further comprising a side wall extending about a perimeter of the substantially flat upper surface and wherein the receptacle comprises a shoulder about an exterior surface of the receptacle wherein the shoulder is substantially even with a bottom edge of the side wall.

5. The tray of claim 4 and wherein the side wall about the perimeter of the generally flat upper surface provide rigidity to the generally flat upper surface.

6. The desk tray of claim 1 and wherein the desk tray is configured to receive a substantially identical desk tray in a nested arrangement.

7. The desk tray of claim 1 and wherein the generally flat upper surface and the receptacle are constructed from an injection molded plastic.

8. The tray of claim 1 and wherein the receptacle is rotatable 360° within the cupholder of the arm rest.

9. A method of converting a theater or auditorium having seats with arm rest cupholders into a classroom or seminar room comprising:

providing a plurality of portable desk trays having a substantially flat continuous top surface the flat top surface extending between and having a perimeter defined by two opposing edges and a forward edge extending between the two opposing edges and being sufficiently large to effectively take notes and the continuous flat surface being free of raised areas between the two opposing edges and the forward edge and a receptacle extending downwardly therefrom, a generally flat back surface area continguous with the generally flat upper surface and a lip extending along the perimeter, the lip having terminal ends at the back surface; and inserting the receptacle into the cupholder such that the arm rest supports the portable desk tray such that books, notepad or a laptop computer are supportable on the substantially flat surface and the back surface area being positioned for accepting a forearm.

10. The method of claim 9 and further comprising rotating the receptacle within the cupholder to position the substantially flat continuous top surface in a selected position.

11. The method of claim 9 and further comprising removing the receptacle from the cupholder at the end of the class or seminar such that the theater or auditorium can be utilized for another purpose.

12. The method of claim 11 and further comprising stacking the desk trays in a nested fashion one on top of another by inserting a receptacle of one desk tray into a receptacle of another desk tray.

* * * * *